United States Patent [19]

Nishikawa et al.

[11] Patent Number: 4,933,252

[45] Date of Patent: Jun. 12, 1990

[54] ELECTROPHOTOGRAPHIC DEVELOPER COMPRISING POLYESTER RESIN OF SPECIFIED ACID AND HYDROXYL VALVES

[75] Inventors: Hideyo Nishikawa; Shingo Tanaka, both of Wakayama, Japan

[73] Assignee: Kao Corporation, Tokyo, Japan

[21] Appl. No.: 59,047

[22] Filed: Jun. 8, 1987

[30] Foreign Application Priority Data

| | | | |
|---|---|---|---|
| Jun. 11, 1986 | [JP] | Japan | 61-135816 |
| Dec. 12, 1986 | [JP] | Japan | 61-296122 |
| Dec. 26, 1986 | [JP] | Japan | 61-309864 |

[51] Int. Cl.[5] ..... G03G 9/00

[52] U.S. Cl. ..... 430/109; 528/128

[58] Field of Search ..... 430/110, 109; 528/128

[56] References Cited

U.S. PATENT DOCUMENTS

| | | | |
|---|---|---|---|
| 3,655,374 | 4/1972 | Palermiti | 430/124 |
| 3,681,106 | 3/1972 | Burns et al. | 430/109 X |
| 4,137,188 | 1/1979 | Vetake et al. | 430/111 |
| 4,216,283 | 8/1980 | Cooper et al. | 430/111 X |
| 4,314,049 | 2/1982 | Yasuda | 528/128 |

FOREIGN PATENT DOCUMENTS

| | | | |
|---|---|---|---|
| A002119 | 5/1979 | European Pat. Off. . | |
| 0085444 | 5/1983 | Japan | 430/109 |
| 2082788 | 3/1982 | United Kingdom . | |

OTHER PUBLICATIONS

Bjorksten, Polyesters and their Applications Rheinhold (1956), pp. 156–167.

Patent Abstracts of Japan, vol. 7, No. 78 (58 7647).

Patent Abstracts of Japan, vol. 10, No. 147 (60 263 950).

Patent Abstracts of Japan, vol. 10, No. 76 (60 214 356).

*Primary Examiner*—J. David Welsh

*Attorney, Agent, or Firm*—Birch, Stewart, Kolasch & Birch

[57] ABSTRACT

An electrophotographic developer, such as a toner binder and a coating on a carrier, comprises a polyester having an acid value of 5 KOH mg/g or less and a hydroxyl value of 60 KOH mg/g or less, having a linear structure without crosslinking or a crosslinked structure provided by a monomer having three or more reactive groups. A toner having the polyester as a binder is effectively charged positively or negatively.

24 Claims, 1 Drawing Sheet

ELECTROPHOTOGRAPHIC DEVELOPER COMPRISING POLYESTER RESIN OF SPECIFIED ACID AND HYDROXYL VALVES

FIELD OF THE INVENTION

This invention concerns a developer composition for developing electrostatic images in electronic photography, electrostatic recording, electrostatic printing, etc.

BACKGROUND OF THE INVENTION

As described in U.S. Pat. Nos. 2,297,691, 2,357,809, etc., the electrophotographic process in the prior art comprises uniformly charging a photoconductive insulation layer, exposing the layer, eliminating electric charges on the exposed area thereby forming electric latent images, visualizing the latent images by depositing electrically charged fine powder referred to as toners to the latent images (developing step), transferring the thus obtained visual images to transfer material such as transfer paper (transfer step) and, thereafter, permanently fixing them by heating, pressurizing or other like adequate fixing process (fixing step).

In this way, toners have to provide functions required not only in the developing step but in each of the transferring and fixing steps.

Furthermore, as the photosensitive material for copying machines, printers, etc. on adopting electrophotographic process, those using organic photosensitive materials in addition to conventional inorganic materials (amorphous selenium alloy, cadmium sulfide, etc.) have been increased in recent years. This is due to easy manufacture, reduced cost, non-toxicity, etc. of the organic photosensitive material.

Most of the organic photosensitive materials require in view of their properties those toners having a positively charged property. Furthermore, development of positively charged toners at high performance has keenly been demanded due to the increased use of laser beam printers or the like that conduct reversing development although the inorganic photosensitive materials are used.

A toner comprising a pigment, a charge-controlling agent and as a binder a vinyl polymer such as a copolymer of styrene and acrylic acid or an epoxy resin has been used. This binder is neutral in view of the electrical charging and it is easy to produce. Those toners using the resins as the binder and capable of satisfying all of important properties for the toners, that is, anti-offset property, blocking resistance, low temperature fixing property, anti-vinyl chloride migration, etc. have not yet been obtained in view of the nature of the resins employed.

That is, in the case of the vinyl polymer represented by the styrene-acryl copolymer, if it is intended to improve the anti-offset property, the softening point and the crosslinking density of the resin have to be increased, at the expense of the low temperature fixing property. On the contrary, if the improvement in the low temperature fixing property is intended, a difficulty arises in the anti-offset property and the blocking resistance. Further, since the solubility parameter of the styrene-acryl copolymer is nearly equal with the solubility parameter of a plasticizer such as dioctyl phthalate contained in vinyl chloride, the plasticizer migrates toward the toners thereby causing contamination of copy images reserved in vinyl chloride sheets and the like.

In the case of using an epoxy resin, although the vinyl chloride migration resistance can be provided, it is very difficult to improve the anti-offset property and low temperature fixing property by the resin alone and, particularly, it can not be used in a device using a heat roll type fixing machine.

Although, improvement has been hitherto attempted for these drawbacks, no solution has yet been obtained.

While on the other hand, polyesters have been noted as a binder resin having a wide molecular weight distribution and capable of satisfying required characteristics such as anti-offset property, low temperature fixing property, blocking resistance and vinyl chloride migration resistance in a well balanced manner. In this case, it has been known that the relationship between the charging property and the acid value of a polyester is substantially in a proportional relationship, that is, the higher the acid value the greater the negative charging property of the resin. Polyesters as described in Japanese Patent Application Laid-Open Nos. Sho 57-37353, 57-109825, etc. are excellent binder resin having cross-linked structures and sufficient negatively charged property without using the charge controller due to their relatively high acid values.

However, if these cross-linked type polyesters are intended to be used as the binder resin for toners having a positively charged property, countermeasures such as the blending of a great amount of positive charge controller are necessary in order to provide the positively charged property, because of the intense negatively charged property of the resin per se. Generally, although a nigrosine dye or the like has been known as a positive charge controller, if the dye is used in a great amount, it shows a poor compatibility with the binder resin constituting the main ingredient of the toners. Thus, if the toner particles are mixed for a long period of time in a developing device, the destruction of the toner particles occur and, in a case where the nigrosine or the like is merely dispersed, particles of adverse (negative) polarity not containing nigrosine are formed thereby causing a so-called background fogging in which toners are deposited to the area where there are no image signals. While on the other hand, if a great amount of the nigrosine dye or the like is used, the amount of charge varies depending on the circumstantial humidity due to the hydrophilic property to degrade the image quality. Further, the nigrosine type dye involves another drawback that it generally shows intense coloration and is not suitable to color toners.

While on the other hand, as copying machines have been used more and more generally, they are often installed under severe conditions. For example, those conditions such as high temperature and high humidity or low temperature and low humidity. Then, it is indispensable that clear images should also be obtained in such severe conditions just as those under normal circumstances. However, although the toners have favorable electric properties such as desirable charging amount and insulation resistance under usual conditions, they are greatly varied under high temperature and high humidity or low temperature and low humidity conditions to often result in the degradation of the images. For example, the image density is reduced under low temperature, low humidity condition, whereas the image density is increased under high temperature and high humidity condition and in an extreme case, almost all of the evenly black portion becomes blank. Those polyesters having hydrophilic carboxyl groups and hydroxyl groups at the terminal ends of the polymer may some time readily suffer from the circumstantial effects as described above if the concentration, that is, the acid value or the hydroxyl value thereof is too high.

Accordingly, the above mentioned conditions have been required for those toners capable of obtaining clear images under all sort of circumstances quite in the same manner as those under the usual circumstantial conditions.

SUMMARY OF THE INVENTION

This invention has been accomplished under the foregoing background, and the object thereof is to provide a toner capable of forming clear images with no fogging by using a toner binder resin having a charging property nearly equal to the neutral property in a developer for use in electronic photography. More specifically, the invention provides for an improved toner without the foregoing drawbacks, suffering from less effects of the circumferential humidity and excellent in durability.

Another object of this invention is to provide a developer that can be easily designed having either a positively or a negatively charged property by the selection of a small amount of charge controller and carrier.

A further object of this invention is to provide a developer capable of preventing offsetting without coating an anti-offset solution in the heat roller fixing system and capable of fixing at a lower fixing temperature.

A further object of this invention is to provide a developer capable of fixing in a shorter period of time and at a lower energy than in the flash fixing or open fixing method.

A further object of this invention is to provide a developer with a favorable flowing property, causing no blocking and showing long work life (e.g. less degradable).

A further object of this invention is to provide a developer excellent in the kneading and pulverizing property upon preparation of the developer.

A further object of this invention is to provide a developer causing no contamination to images even upon contact with sheets or files made of vinyl chloride resin.

BRIEF DESCRIPTION OF THE DRAWINGS

1. . . . plunger
2. . . . cylinder
3. . . . specimen
4. . . . nozzle
5. . . . nozzle retainer

DETAILED DESCRIPTION OF THE INVENTION

Figure 1:
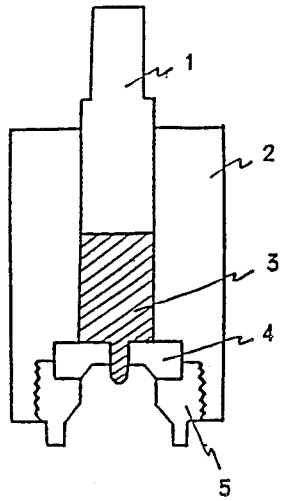
FIG. 1 is a schematic cross sectional view illustrating a main portion of a Kohka type flow tester, wherein the elements thereof are as defined as follows.

The present inventors have made an earnest study for attaining the foregoing objects and, as a result, have accomplished this invention.

The invention provides use of a polyester for an electrophotographic developer, such as a toner binder and a coating on a carrier. The toner composition of the invention comprises a colorant and a polyester having an acid value of 5 KOH mg/g or less and a hydroxyl value of 60 KOH mg/g or less. The carrier of the invention comprises core particles and a coating thereon comprising the polyester.

A preferable polyester of the invention has a hydroxyl value of 50 KOH mg/g and has a linear structure without crosslinking. Another preferable polyester has been crosslinked and has been produced by using a monomer having three or more reactive groups.

A toner composition of the invention may further comprise an electric charge-controlling agent which serves for the positive or negative charge.

The polyester to use in the invention includes a crosslinked one and a linear one.

The invention will be explained below first in reference to the crosslinked polyester.

Specifically, this invention concerns a developer composition for use in electronic photography containing a thermoplastic resin as an essential ingredient, wherein the thermoplastic resin is a polyester having at least one tri- or higher valent polyfunctional compound as the constituent unit with an acid value of less than 5 KOHmg/g and a hydroxyl value of less than 60 KOHmg/g.

The alcohol monomer among the monomers constituting the polyester in this invention can include, together with tri- or higher valent polyfunctional monomers, for example, diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol and 1,6-hexanediol; bisphenol A, hydrogenated bisphenol A, bisphenol A alkylene oxide adduct such a polyoxyethylene bisphenol A and polyoxypropylene bisphenol A, other dihydric alcohols, or tri- or higher valent alcohols such as sorbitol, 1,2,3,6-hexanetetrol, 1,4-sorbitane, pentaerythrytol, dipentaerythrytol, tripenterythrytol, 1,2,4-butanetriol, 1,2,5-pentanetriol, glycelol, diglycelol, 2-methylpropanetriol, 2-methyl-1,2,4-butanetriol, trimethylolethane, trimethylolpropane, 1,3,5-trihydroxybenzene and the like Among the monomers as described above, those systems using the bisphenol A alkylene oxide adduct as the main ingredient monomer show particularly preferred result.

In the case of using the bisphenol A alkylene oxide adduct as the constituent monomer, a polyester having a relatively high glass transition point can be obtained in view of the nature of the bisphenol A skeleton and the anti-blocking property is preferred. Further, alkyl groups present on both sides of the bisphenol A skeleton function as soft segments in the polymer to render the low temperature fixing property favorable Among the monomers constituting the polyester in this invention, the acid monomer, together with tri- or higher valent polyfunctional monomers can include, for example, maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkenyl succinic acids such as n-dodecenyl succinic acid and n-dodecyl succinic acid, anhydrides and alkyl esters of these acids, as well as other dibasic carboxylic acids, 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, tetra(methylenecarboxyl)methane, 1,2,7,8-octane tetracarboxylic acid, Empol, a tradename of trimer acid anhydride, alkyl esters, alkenyl esters and aryl esters of these acids, as well as other tri- or higher valent carboxylic acids.

Specific examples of the alkyl, alkenyl or aryl esters stated herein can include, for example, case of 1,2,4-benzene tricarboxylic acid, trimethyl 1,2,4-benzene tricarboxylate, triethyl 1,2,4-benzene tricarboxylate and tri-n-butyl 1,2,4-benzene tricarboxylate, tri-iso-butyl 1,2,4-benzene tricarboxylate, tri-n-octyl 1,2,4-benzene tricarboxylate, tri-2-ethylhexyl 1,2,4-benzene tricarboxylate, tribenzyl 1,2,4-benzene tricarboxylate and tris(4-isopropylbenzyl) 1,2,4-benzene tricarboxylate.

In the case of using a great amount of tri- or higher valent carboxylic acid or the anhydride thereof among the monomer as described above, if the acid value is maintained to lower than 5 KOHmg/g, caution has to be taken since the risk of gelation may occur upon preparation of the resin.

Among the polymers as described above, those systems using the monomers represented by the following formula (I):

(I)

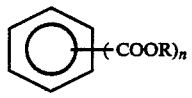

where n is 3 or 4, R is an alkyl, alkenyl or aryl group with 1 to 18 carbon atoms particularly show a preferred result.

Since the reaction for the monomer of the formula (I) is proceeded through the transesterification, the molecular weight can be increased and the crosslinking structure can be introduced regardless of the acid value of the resin. The acid value is kept low as it is.

A preferred blending ratio of the monomer of the formula (I) is from 2 to 50 mol % in the constituent unit for the acid ingredient If it is less than 2 mol %, no sufficient crosslinked structure can be obtained thereby failing to improve the anti-offset property. If it is greater than 50 mol %, a risk of gelation may occur upon preparing the resin.

Then, it is necessary that the acid value of the polyester in this invention has to be reduced to 5 KOHmg/g in view of the nature. If it exceeds 5 KOHmg/g, the negatively charged property of the resin per se is increased making it difficult for use in a toner having a positively charged property by itself.

Further, in the case where the hydroxyl value exceeds 60 KOHmg/g, the molecular weight is necessarily reduced to address problems in the anti-offset property and the blocking resistance. Then, in order to satisfy the thermal characteristics as the important required properties for the toners, it is preferred that the resin used herein has a crosslinked structure using at least one tri- or higher valent polyfunctional monomer having the softening point measured by a flow tester having a tradename of Kohkashiki, available from Shimadzu Corp, of 90° to 150° C. and with a temperature difference between the flow starting point and the softening point of 15° C. to 50° C. (the flow tester of Kohkashiki, also called Kohka type flow tester, used herein is such a device which is capable of measuring the melting behavior of the resin, etc. at each of the temperatures simply and at a good reproducibility and extremely effective for the evaluation of resins for use in toners and binders). If the tri- or higher valent polyfunctional monomer, that is, a crosslinker is not used, the anti-offset property is worsened. Further, the anti-offset property and the blocking-resistance are worsened if the softening point is lower than 90° C., whereas the low temperature fixing property is worsened if the softening point exceeds 150° C. Further, referring to the temperature difference between the flow starting point and the softening point, the anti-offset property and the blocking-resistance are worsened if it is less than 15° C., whereas the low temperature fixing property is worsened if it exceeds 50° C.

The invention will be explained below in reference to another embodiment in which a polyester of a dibasic acid and a diol is used and has a linear structure without crosslinking.

The alcohol monomer among the monomers constituting the polyester in this invention can include, for example, diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol and 1,6-hexanediol; bisphenol A, hydrogenated bisphenol A, bisphenol A alkylene oxide adduct such as polyoxyethylene bisphenol A and polyoxypropylene bisphenol A, as well as other dihydric alcohols Among the monomers as described above, those systems using the bisphenol A alkylene oxide adduct as the main ingredient monomer show a particularly preferred result.

Among the monomers constituting the polyester in this invention, the acid monomer can include, for example, maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkenyl succinic acids such as n-dodecenyl succinic acid and n-dodecyl succinic acid, anhydrides and alkyl esters of these acids, as well as other dibasic carboxylic acids.

Then, in order to satisfy the thermal characteristics the important required properties for the toners, it is preferred that the resin used herein has an adequate molecular weight. More specifically, it is preferred that the softening point as measured by the Kohka type flow tester is 80°-140° C. and the temperature difference between the flow starting point and the softening point is 10° C.-40° C. The anti-offset property and the blocking-resistance are worsened if the softening point is lower than 80° C., whereas the low temperature fixing property is worsened if the softening point exceeds 140° C. Further, referring to the temperature difference between the flow starting point and the softening point, the anti-offset property and the blocking-resistance are worsened if it is less than 10° C., whereas the low temperature fixing property is worsened if it exceeds 40° C.

The polyester resin in this invention can be synthesized by the customary method. Specifically, the reaction may be conducted at a reaction temperature (170° C.-250° C.) and under a reaction pressure (5 mmHg - atmospheric pressure) while determining the optimum temperature and pressure depending on the reactivity of the monomer, etc and the reaction may be ended at an instance where predetermined physical properties are obtained The developer for use in electronic photography in this invention can be prepared by the ordinary method The colorant usable in this invention can include, for example, various kinds of carbon blacks manufactured by thermal black method, acetylene black method, channel black method, furnace black method and lamp black method in the case of black toner, and copper phthalocyanine, monoazo type pigment (C I Pigment Red 5, C.I. Pigment Orange 36, C.I. Pigment Red 22), disazo type pigment (C I Pigment Yellow 83), anthraquinone type pigment (C.I. Pigment blue 60), disazo type pigment (Solvent Red 19) and rohdamine type dye (solvent Red 49), etc. in the case of color toners They are sufficiently dispersed uniformly together with the thermoplastic resin and, depending on the case, positive or negative charge controller in a ball mill or the like, melted and kneaded in a kneader, cooled, and then pulverized for use as pigmented powder, that is, toners of an average particle size from 5 to 15 μm. As the dry type two component developer, the toners as described above are blended with iron carrier, ferrite type coat carrier, true spherical coat carrier and like other magnetic powder blended in an appropriate amount for use as the developer.

The positive charge controller usable in this invention can include from low molecular compounds to high molecular compounds (including polymer) with no particular restrictions For instance, there can be mentioned nigrosine type dye; "Nigrosine base EX", "Oil Black BS", "Oil Black SO" (they are manufactured by Orient Chemical Co.), or triphenyl methane type dye, quarternary ammonium compound, a vinyl polymer having an amino groups and so on.

The content of the positive charge controller in the developer composition for use in electronic photography according to this invention is preferably from 0.1 to 8.0 parts by weight and, more preferably, from 0.5 to 3.0 parts by weight based on 100 parts by weight of the thermoplastic resin. However, in the case where the positive charge controller is a vinyl polymer containing amino groups, it may be used in a greater amount.

The negative charge controller usable in this invention can include, for example, metal complex salt of monoazo dye, nitrohumic acid and salt thereof, materials having nitro group or halogen element, sulfonated copper phthalocyanine, maleic acid anhydride copolymer, etc.

Further, fine magnetic powder can be incorporated into the toners in view of the developing mechanism or with an aim of improving the image. The magnetic powder can include alloys or compounds of elements showing ferromagnetic property such as ferrite and magnetite, and the magnetic material can be used while being dispersed in the thermoplastic resin in the form of fine powder having an average grain size from 0.05 to 1 μm in an amount from 30 to 70 % by weight.

Further, there can also be mentioned, as the known characteristic improvers incorporated into the toners according to this invention, an anti-offset agent, fluidizing agent, thermal property improver (for example, metal complex such as chromium complex of 3,5-di-tertiary butyl salicylic acid or metal oxide such as zinc oxide) and they can be used properly without hindering the object of this invention.

The acid value and the hydroxy value of the polyester resin in this invention is measured according to the method of JIS K 0070. In the case where the resin is less soluble to the solvent, a good solvent such as dioxane may be used.

Figure 2:
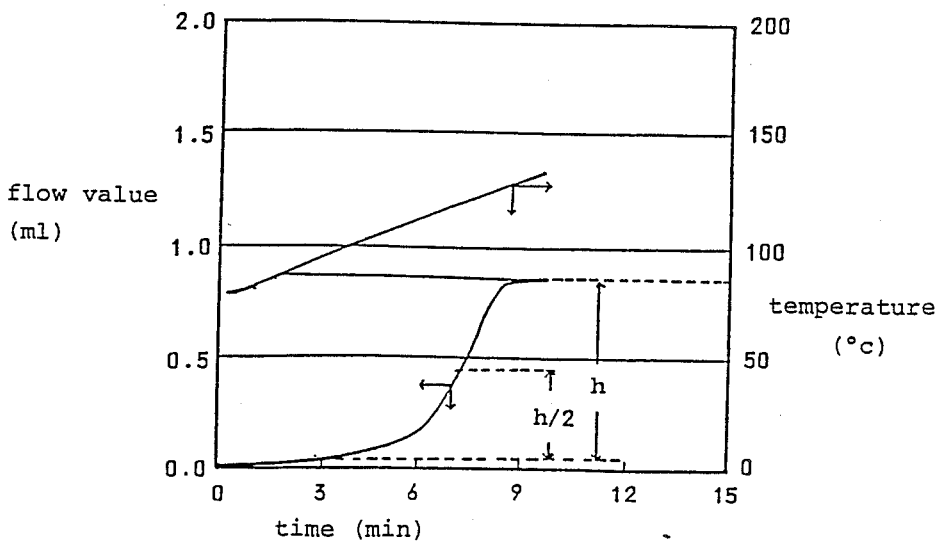
FIG. 2 is a flow down amount (flow value)-temperature curve of a flow tester plunger.

Referring to FIG. 1, the outline of the Kohka type flow tester used in this invention is described in JIS K 7210. For measuring the Kohka type flow tester softening point, specimen 3 of 1 $cm^3$ volume was extruded from nozzle 4 of 1 mm diameter and 1 mm length by using a Kohka type flow tester (manufactured by Shimazu Seisakusho) while heating the specimen at a rising temperature rate of 6° C./min and while applying a load of 20 $kg/cm^2$ by plunger 1. Then, a plunger lowering amount (flow value) - temperature curve of the flow tester as shown in FIG. 2 is drawn and a temperature corresponding to h/2 (where h represents the height for the S-shaped curve) is set as the softening point. Further, the temperature at which the resin began to melt and thereby the plunger is started to move downward is set as the flow starting point.

EXAMPLES

This invention will now be described by way of its examples but the invention is no way limited to these examples.

The composition ratio shown in the examples represents parts by weight unless otherwise specified

| Preparation Example 1 (Preparation of Resin A) | |
|---|---|
| Polyoxypropylene(2,2)-2,2-bis(4-hydroxyphenyl) propane | 740 g |
| Polyoxyethylene(2,2)-2,2-bis(4-hydroxyphenyl) Propane | 300 g |
| Dimethyl terephthalate | 466 g |
| Isododecenyl succinic acid anhydride | 80 g |
| Tri-n-butyl 1,2,4-benzene tricarboxylate | 114 g |

The above-mentioned materials were charged together with a usual esterifying catalyst in a 2 liter volume four necked flask made of glass, to which were attached a thermometer, a stirrer made of stainless steels, a flow down type condenser and a nitrogen introduction pipe, and the reaction was proceeded in an electrically heated mantle heated under a nitrogen gas stream by stirring under an ambient temperature at 210° C. in the former half stage and under a reduced pressure 210° C. at the latter half stage.

The thus obtained resin had an acid value of 2.3 KOHmg/g, a hydroxyl value of 28.0 KOHmg/g, a softening point measured by the Kohka type flow tester of 135.7° C. and a flow starting point of 102° C.

| Preparation Example 2 (Preparation of Resin B) | |
|---|---|
| Polyoxypropylene(2,2)-2,2-bis(4-hydroxyphenyl) propane | 1050 g |
| Fumaric acid | 298 g |
| Tri-2-ethylhexyl 1,2,4-benzene tricarboxylate | 156 g |
| Methyl hydroquinoneo (polymerization inhibitor) | 0.5 g |

The above-mentioned materials were reacted by using the same device as in the Preparation Example 1 at 185° C. under an ambient pressure at the former stage and at 210° C. at a reduced pressure at the latter stage of the reaction.

The thus obtained resin had an acid value of 1.8 KOHmg/g, a hydroxyl value of 33.5 KOHmg/g, a softening point measured by the Kohka type flow tester of 129.5° C. and a flow starting point of 98° C.

| Preparation Example 3 (Preparation of Resin C) | |
|---|---|
| Polyoxypropylene(3,2)-2,2-bis(4-hydroxyphenyl) propane | 1224 g |
| Terephthalic acid | 398 g |
| n-dodecyl succinic acid anhydride | 80 g |
| Tetramethyl 1,2,4,5-benzene tetracarboxylate | 93 g |

The above mentioned materials were charged together with an usual esterifying catalyst and the reaction was proceeded in the same apparatus and the same procedures as those in Preparation Example 1.

The thus obtained resin had an acid value of 3.5 KOHmg/g, a hydroxyl value of 43.0 KOHmg/g, a softening point measured by the Kohka type flow tester of 140.5° C. and a flow starting point of 108° C.

| Preparation Example 4 (Preparation of Resin D) | |
|---|---|
| Polyoxypropylene(2,2)-2,2-bis(4-hydroxyphenyl) propane | 1050 g |
| Isophthalic acid | 374 g |
| Trimethyl 1,2,4-benzene tricarboxylate | 151 g |
| Glycerine | 15 g |

The above mentioned materials were charged together with an usual esterifying catalyst and the reaction was proceeded in the same apparatus and the same procedures as those in Preparation Example 1.

The thus obtained resin had an acid value of 4.7 KOHmg/g, a hydroxyl value of 37.0 KOHmg/g, a softening point measured by the Kohka type flow tester of 135.7° C. and a flow starting point of 100° C.

| Preparation Example 5 (Preparation of Resin E) | |
|---|---|
| Polyoxypropylene(2,2)-2,2-bis(4-hydroxyphenyl) propane | 770 g |
| Polyoxyethylene(2,2)-2,2-bis(4-hydroxyphenyl) propane | 720 g |
| Terephthalic acid | 690 g |
| Tri-2-ethylhexyl 1,2,4-benzene tricarboxylate | 120 g |

The above mentioned materials were charged together with an usual esterifying catalyst and the reaction was proceeded in the same apparatus and the same procedures as those in Preparation Example 1.

The thus obtained resin had an acid value of 2.3 KOHmg/g, a hydroxyl value of 22.0 KOHmg/g, a softening point measured by the Kohka type flow tester of 103.0° C. and a flow starting point of 82.0° C.

| Preparation Example 6 (Preparation of Resin F) | |
|---|---|
| Polyoxypropylene(2,2)-2,2-bis(4-hydroxyphenyl) propane | 700 g |
| Polyoxyethylene(2,2)-2,2-bis(4-hydroxyphenyl) propane | 330 g |
| Terephthalic acid | 170 g |
| Isodecenyl succinic acid anhydride | 260 g |
| Trimethyl 1,2,4-benzene tricarboxylate | 240 g |

The above mentioned materials were charged together with an usual esterifying catalyst and the reaction was proceeded in the same apparatus and the same procedures as those in Preparation Example 1.

The thus obtained resin had an acid value of 1.7 KOHm/g, a hydroxyl value of 19.5 KOHmg/g, a softening int measured by the Kohka type flow tester of 122.5° C. and the flow starting point of 95.5° C.

| Preparation Example 7 (Preparaton of Resin G) | |
|---|---|
| Polyoxypropylene(2,2)-2,2-bis(4-hydroxyphenyl) propane | 720 g |
| Polyoxyethylene(2,2)-2,2-bis(4-hydroxyphenyl) propane | 300 g |
| Terephthalic acid | 160 g |
| Isodecenyl succinic acid anhydride | 260 g |
| Triethyl 1,2,4-benzene tricarboxylate | 290 g |

The above mentioned materials were charged together with an usual esterifying catalyst and the reaction was proceeded in the same apparatus and the same procedures as those in Preparation Example 1.

The thus obtained resin had an acid value of 3.8 KOHmg/g, a hydroxyl value of 10.5 KOHmg/g, a softening point measured by the Kohka type flow tester of 142.3° C. and the flow starting point of 109.0° C.

| Preparation Example 8 (Preparation of Resin H) | |
|---|---|
| Polyoxypropylene(2,2)-2,2-bis(4-hydroxyphenyl) propane | 1225 g |
| Polyoxyethylene(2,2)-2,2-bis(4-hydroxyphenyl) propane | 165 g |
| Fumaric acid | 350 g |
| Trimethyl 1,2,4-benzene tricarboxylate | 250 g |
| Hydroquinone (polymerization inhibitor) | 0.5 g |

The above mentioned materials were reacted in the same apparatus and the same procedures as those in Preparation Example 2.

| Preparation Example 9 (Preparation of Resin I) | |
|---|---|
| Polyoxypropylene(2,2)-2,2-bis(4-hydroxyphenyl) propane | 1225 g |
| Polyoxyethylene(2,2)-2,2-bis(4-hydroxyphenyl) propane | 165 g |
| Fumaric acid | 350 g |
| Triethyl 1,2,4-benzene tricarboxylate | 290 g |
| Hydroquinone (polymerization inhibitor) | 0.5 g |

The above mentioned materials were reacted in the same apparatus and the same procedures as those in Preparation Example 2.

The thus obtained resin had an acid value of 4.0 KOHmg/g, a hydroxyl value of 28.8 KOHmg/g, a softening point measured by the Kohka type flow tester of 133.5° C. and the flow starting point 100.2° C.

| Preparation Example 10 (Preparation of Resin J) | |
|---|---|
| Polyoxypropylene(2,2)-2,2-bis(4-hydroxyphenyl) propane | 1225 g |
| Polyoxyethylene(2,2)-2,2-bis(4-hydroxyphenyl) propane | 165 g |
| Terephthalic acid | 500 g |
| Isododecenyl succinic anhydride | 130 g |
| Triisopropyl-1,2,4-benzene tricarboxylate | 170 g |

The above mentioned materials were reacted together with an usual esterifying catalyst in the same apparatus and the same procedures as those in Preparation Example 1.

The thus obtained resin had an acid value of 0.5 KOHmg/g, a hydroxyl value of 28.4 KOHmg/g, a softening point measured by the Kohka type flow tester of 127.4° C. and the flow starting point of 81.4° C.

Preparation Example 11 (Preparation of Resin K, for Comparison)

The reaction was started quite in the same manner excepting for changing tri-n-butyl 1,2,4-benzene tricarboxylate in Preparation Example 1 into 58 g of 1,2,4-benzene tricarboxylic acid. The reaction was proceeded while tracing the acid value, but as the acid value approached 15 KOHmg/g, the viscosity of the resin was suddenly increased and the resin was finally gelled Upon measuring the acid value for making it sure, it was 13.0 KOHmg/g.

Preparation Example 12 (Preparation of Resin L, for comparison)

| | |
|---|---|
| Polyoxypropylene(2,2)-2,2-bis(4-hydroxyphenyl) propane | 1400 g |
| Dimethyl terephthalate | 780 g |

The above mentioned materials were reacted together with an usual esterifying catalyst in the same apparatus and the same procedures as those in Preparation Example 1.

The thus obtained resin had an acid value of 1.4 KOHmg/g, a hydroxyl value of 15.2 KOHmg/g, a softening point measured by the Kohka type flow tester of 120.4° C. and a flow starting point of 92.0° C.

Preparation Example 13 (Preparation of Resin M, for comparison)

The reaction was proceeded quite in the same procedures as in the Preparation Example 2 except for using 55 g of 1,2,4-benzene tricarboxylic acid instead of tri-2-ethylhexyl 1,2,4-benzene tricarboxylate in the Preparation Example 2.

The thus obtained resin had an acid value of 19.5 KOHmg/g, a hydroxyl value of 37.2 KOHmg/g, a softening point measured by the Kohka type flow tester of 133.2° C. and a flow starting point of 102° C.

Examples 1–11 and Comparative Examples 1–8

After mixing the materials of the following composition in the ball mill, they were melted and kneaded in a kneader under pressure, cooled and by way of usual pulverizing and classifying steps, toners of an average grain size of 11 μm were prepared.

| Composition | |
|---|---|
| Example 1 | |
| Resin A | 89 parts |
| Carbon Black "Carbon Black #44 (manufactured by Mitsubishi Kasei Co.)" | 6 parts |
| Charge controller "Nigrosine base EX (manufactured by Orient Chemical Co)" | 2 parts |
| Wax "Biscol 550P (manufactured by Sanyo Kasei Co.)" | 3 parts |

EXAMPLE 2

The composition was quite identical with that in Example 1 except for using resin B instead of resin A in Example 1.

EXAMPLE 3

The composition was quite identical with that in Example 1 except for using resin C instead of resin A in Example 1.

EXAMPLE 4

The composition was quite identical with that in Example 1 except for using resin D instead of resin A in Example 1.

| | |
|---|---|
| Example 5 | |
| Resin F | 79 parts |
| Carbon black "Carbon black #44 (manufactured by Mitsubishi Kasei Co.)" | 6 parts |
| Charge control polymer (styrene-butyl methacrylate-dimethylaminoethyl methacrylate copolymer resin) | 15 parts |
| Example 6 | |
| Resin E | 91 parts |
| Carbon black "Carbon black #44 (manufactured by Mitsubishi Kasei Co.)" | 6 parts |
| Wax "Biscol 550P (manufactured by Sanyo Kasei Co.)" | 3 parts |
| Example 7 | |
| Resin F | 89 parts |
| Carbon black "Carbon black #44 (manufactured by Mitsubishi Kasei Co.)" | 6 parts |
| Charge controller "Bontron S-31 (manufactured by Orient Chemical Co.)" | 2 parts |
| Wax "Biscol 550P (manufactured by Sanyo Kasei Co.)" | 3 parts |

EXAMPLE 8

The composition was quite identical with that in Example 7 except for using resin G instead of resin F in Example 7.

EXAMPLE 9

The composition was quite identical with that in Example 7 except for using resin H instead of resin F in Example 1.

EXAMPLE 10

The composition was quite identical with that in Example 7 except for using resin I instead of resin F in Example 1.

| Example 11 | |
|---|---|
| Resin J | 91 parts |
| Carbon black "Carbon black #44 (manufactured by Mitsubishi Kasei Co.)" | 6 parts |
| Wax "Biscol 550P (manufactured by Sanyo Kasei Co.)" | 3 parts |

COMPARATIVE EXAMPLE 1

The composition was quite identical with that in Example 1 except for using resin L instead of resin A in Example 1.

COMPARATIVE EXAMPLE 2

The composition was quite identical with that in Example 1 except for using resin M instead of resin A in Example 1.

COMPARATIVE EXAMPLE 3

The composition was quite identical with that in Example 1 except that resin A was replaced by a styrene and acrylic copolymer having a softening point of 130.2° C. and being of the crosslinked type.

COMPARATIVE EXAMPLE 4

The composition was quite identical with that in Example 1 except for using an epoxy resin "Epicoat 1007 (being available from Yuka Shell Epoxy Co.)" instead of the resin A in Example 1.

COMPARATIVE EXAMPLE 5

The composition was quite identical with that in Example 7 except for using resin L instead of the resin F in Example 7.

COMPARATIVE EXAMPLE 6

The composition was quite identical with that in Example 7 except for using resin M instead of the resin F in Example 7.

COMPARATIVE EXAMPLE 7

The composition was quite identical with that in Example 7 except for using styren-acryl copolymer resin used in Comparative Example 3 instead of the resin F in Example 7.

COMPARATIVE EXAMPLE 8

The composition was quite identical with that in Example 7 except for using epoxy resin used in Comparative Example 4 instead of the resin F in Example 7.

The toners obtained in Examples 1-11 are referred to as toner 1 - toner 11 respectively, while the toners obtained in Comparative Examples 1-8 are respectively referred as Comparative toner 1 - Comparative toner 8.

Each 39 g of the toners, 1261 g of resin-coated iron powder and 7 g of a fluidizing agent were mixed to prepare a developer, and the triboelectric charging amount of the respective developers was measured by a blow-off method. Then, the images were formed by a commercially available electrophotographic copying machine (organic photosensitive material was used as the photosensitive material for toners 1-6 and Comparative toners 1-4, while Se type photosensitive material was used as the photosensitive material for the toners 7-11 and Comparative toners 5-8. The rotating speed of the fixing roller was 255 mm/sec, the heat roller temperature in the fixing device was made variable and the oil-coating device was removed).

The fixing temperature was controlled to 120° C.-220° C. and the result of the evaluation for the fixing property and the offset property of the images are shown in Tables 1 and 2.

The lowest fixing temperature is defined as below A 500 g weight was loaded on a sand erasing rubber having a bottom face of 15 mm×7.5 mm, images fixed through a fixing machine were rubbed for five reciprocal strokes, an optical reflection density was measured before and after the rubbing by a reflection densitometer manufactured by Macbeth Co., and the temperature of the fixing roller when the fixing rate by the following definition exceeds 70% is defined as the lowest fixing temperature.

$$\text{Fixing rate} = \frac{\text{image density after rubbing}}{\text{image density before rubbing}}$$

For the store-stability, the degree of occurrence of coagulation when each of the toners was left for 24 hours under the conditions of a temperature at 50° C. and a relative humidity of 40% was evaluated. The results are also shown in Tables 1 and 2.

Further, referring to the vinyl chloride migration resistance, images obtained after fixing were put between vinyl chloride sheets and the state of contamination to images and the vinyl chloride sheets after leaving for one week under a load of 100 g/cm$^2$ at 40° C. was evaluated. The results are also shown in Tables 1 and 2.

Further, referring to the circumstantial stability, image stability at high temperature and high humidity (35° C., 85%RH), and low temperature and low humidity (10° C., 15%RH) were evaluated The results are also shown in Tables 1 and 2.

TABLE 1

| Toner | Friction charge amount (uc/g) | Lowest fixing temperature (°C.) | Low temperature offset eliminating temperature (°C.) | High temperature offset generating temperature (°C.) | Store stability | Vinyl chloride migration resistance | Circumstantial stability |
|---|---|---|---|---|---|---|---|
| Toner 1 | +14.2 | 154 | 147 | 220< | good | no contamination | good |
| Toner 2 | +13.8 | 155 | 145 | 220< | good | no contamination | " |
| Toner 3 | +15.5 | 152 | 145 | 220< | good | no contamination | " |
| Toner 4 | +14.0 | 158 | 148 | 220< | good | no contamination | " |
| Toner 5 | +13.5 | 150 | 145 | 220< | good | no contamination | " |
| Toner 6 | +13.8* | 145 | 138 | 180 | good | no contamination | " |
| Comparative toner 1 | +13.0 | 153 | 149 | 160 | favorable | slightly contamination | " |
| Comparative toner 2 | +2.1 | about 160** | about 150** | about 220<** | good | no contamination | —** |
| Comparative toner 3 | +15.0 | 185 | 170 | 210 | favorable | remarkable contamination | failed |
| Comparative toner 4 | +13.0 | 163 | 155 | 160 | favorable | no contamination | failed |

(note)
*For toner 6, negatively charged property was provided with no charge controller by changing the coat resin for the carrier.
**For the comparative toner 2, no clear images were obtained and accurate numerical values and evaluation were not obtained since the charged amount of the toner was too low.

TABLE 2

| Toner | Friction charge amount (uc/g) | Lowest fixing temperature (°C.) | Low temperature offset eliminating temperature (°C.) | High temperature offset generating temperature (°C.) | Store stability | Vinyl chloride migration resistance | Circumstantial stability |
|---|---|---|---|---|---|---|---|
| Toner 7 | −13.5 | 152 | 145 | 220< | Good | no contamination | good |
| Toner 8 | −14.4 | 160 | 145 | 220< | " | no contamination | " |
| Toner 9 | −12.9 | 149 | 140 | 220< | " | no contamination | " |
| Toner 10 | −13.0 | 156 | 145 | 220< | " | no contamination | " |
| Toner 11 | −13.0* | 152 | 145 | 220< | " | no contamination | " |
| Comparative Toner 5 | −12.5 | 150 | 150 | 155 | favorable | slightly contamination | " |
| Comparative toner 6 | −21.8 | 155 | 150 | 220< | good | no contamination | " |
| Comparative toner 7 | −13.0 | 180 | 175 | 200 | favorable | remarkable contamination | failed |
| Comparative toner 8 | −12.2 | 165 | 160 | 170 | favorable | no contamination | failed |

| Preparation Example 14 (Preparation of Resin N) | |
|---|---|
| Polyoxypropylene(2,2)-2,2-bis(4-hydroxyphenyl propane | 720 g |
| Polyoxyethylene(2,2)-2,2-bis(4-hydroxyphenyl) Propane | 660 g |
| Fumaric acid | 465 g |
| Hydroquinone (polymerization inhibitor) | 0.5 g |

(note)
*For toner 11, negatively charged property was provided with no charge controller by varying the coat resin for the carrier.

The above-mentioned materials were charged in a 2 liter volume four necked flask made of glass, to which were attached a thermometer, a stirrer made of stainless steel, a flow down type condenser and a nitrogen introduction pipe, and the reaction was proceeded in an electrically heated mantle heated under a nitrogen gas stream by stirring under an ambient temperature at 185° C. in the former half stage and under a reduced pressure 200° C. at the latter half stage.

The thus obtained resin had an acid value of 1.4 KOHmg/g, a hydroxyl value of 18.9 KOHmg/g, a softening point measured by the Kohka type flow tester of 119.3° C. and a flow starting point of 95.8° C.

| Preparation Example 15 (Preparation of Resin O) | |
|---|---|
| Polyoxypropylene(2,2)-2,2-bis(4-hydroxyphenyl) propane | 1050 g |
| Polyoxyethylene(2,2)-2,2-bis(4-hydroxyphenyl) propane | 325 g |
| Terephthalic acid | 500 g |
| Isodecenyl succinic acid anhydride | 270 g |

The above-mentioned materials were reacted by using the same device as in the Preparation Example 1 at 220° C. under an ambient pressure at the former stage and at 220° C. at a reduced pressure at the latter stage of the reaction.

The thus obtained resin had an acid value of 2.3 KOHmg/g, a hydroxyl value of 20.2 KOHmg/g, a softening point measured by the Kohka type flow tester of 128.0° C. and a flow starting point of 99° C.

| Preparation Example 16 (Preparation of Resin P) | |
|---|---|
| Polyoxypropylene(2,2)-2,2-bis(4-hydroxyphenyl) propane | 1050 g |
| Polyoxyethylene(2,2)-2,2-bis(4-hydroxyphenyl) propane | 325 g |
| Terephthalic acid | 330 g |
| Fumaric acid | 240 g |

-continued

| Preparation Example 16 (Preparation of Resin P) | |
|---|---|
| Hyroquinone (polymerization inhibitor) | 0.5 g |

The above mentioned materials were reacted together with an usual esterifying catalyst in the same apparatus and the same procedures as those in Preparation Example 1.

The thus obtained resin had an acid value of 3.5 KOHmg/g, a hydroxyl value of 42.8 KOHmg/g, a softening point measured by the Kohka type flow tester of 119.2° C. and a flow starting point of 94.2° C.

| Preparation Example 17 (Preparation of Resin Q) | |
|---|---|
| Ethylene glycol | 40 g |
| Propylene glycol | 30 g |
| Dipropylene glycol | 400 g |
| Dimethyl terephthalate | 580 g |
| Fumaric acid | 120 g |
| Hydroquinone (polymerization inhibitor) | 0.5 g |

The above mentioned materials were reacted together with an usual esterifying catalyst in the same apparatus and the same procedures as those in Preparation Example 1.

The thus obtained resin had an acid value of 4.5 KOHmg/g, a hydroxyl value of 14.8 KOHmg/g, a softening point measured by the Kohka type flow tester of 08.2° C. and a flow starting point of 83.3° C.

Preparation Example 18 (Preparation of Resin R for comparison)

The synthesis was conducted for the same composition as in the Preparation Example 1 while tracing the acid value. The reaction was ended when the acid value reduced to less than 15.0 KOHmg/g.

The thus obtained resin had an acid value of 10.2 KOHmg/g, a hydroxyl value of 27.9 KOHmg/g, a softening point measured by the Kohka type flow tester of 100.3° C. and a flow starting point of 87.2° C.

EXAMPLES 12-21 and COMPARATIVE EXAMPLES 9 to 14

After mixing the materials of the following compositions in the ball mill, they were melted and kneaded in a kneader under pressure, cooled and by way of usual pulverizing and classifying steps, toners of an average grain size of 11 μm were prepared.

| Composition | |
|---|---|
| Example 12 | |
| Resin N | 89 parts |
| Carbon Black "Carbon Black #44 (manufactured by Mitsubishi Kasei Co.)" | 6 parts |
| Charge controller "Nigrosine base EX (manufactured by Orient Chemical Co)" | 2 parts |
| Wax "Biscol 550P (manufactured by Sanyo Kasei Co.)" | 3 parts |

EXAMPLES 13, 14 and 15

Compositions were prepared in the same way as shown in Example 12, except for using the resins O, P and Q, respectively, instead of the resin N.

| | |
|---|---|
| Example 16 | |
| Resin N | 71 parts |
| Carbon black "Carbon black #44 (manufactured by Mitsubishi Kasei Co.)" | 6 parts |
| Charge control polymer (styrene-butyl methacrylate-dimethylaminoethyl methacrylate copolymer resin) | 10 parts |
| Wax "Biscol 550P (manufactured by Sanyo Kasei Co.)" | 3 parts |
| Example 17 | |
| Resin O | 91 parts |
| Carbon black "Carbon black #44 (manufactured by Mitsubishi Kasei Co.)" | 6 parts |
| Wax "Biscol 550P (manufactured by Sanyo Kasei Co.)" | 3 parts |

EXAMPLES 18, 19, 20 and 21

Compositions were prepared in the same way as shown in Examples 12, 13, 14 and 15, respectively, except for using a charge controller having a tradename of "Bontron S-31", available from Orient Chemical Co., Ltd., for the respective charge controllers.

COMPARATIVE EXAMPLE 9

A composition was prepared in the same way as shown in Example 12, except for using the resin R instead of the resin N.

COMPARATIVE EXAMPLE 10

A composition was prepared in the same way as shown in Example 12, except for using a styrene-acryl copolymer which is not crosslinked and has a softening point of 123.1° C. instead of the resin N.

COMPARATIVE EXAMPLE 11, 12, 13 and 14

Compositions were prepared in the same way as shown in Comparative Examples 9, 10, 3 and 4, respectively, except for using a charge controller having a tradename of "Bontron S-31", instead of the respective charge controllers.

In the above shown tests, the toners 12 to 21 and the comparative toners 9 to 14 were obtained in Examples 12 to 21 and Comparative Examples 9 to 14, respectively.

Developers each comprising a toner and a carrier were prepared and examined in the electrophotographic properties in the same way as shown before, except that an electrophotographic laser beam printer, being modified and available in the commercial market, was instead used, in which two photosensitive materials, selenium and an organic material, and a flashing optical source to adjust the amount of light used.

Images were formed by using an organic type photosensitive material for the toners showing charged amount of positive value and by using a Se type photosensitive material for the toners showing charged amount of negative values.

Fixation was determined by observation.

TABLE 3

| Toner | Friction charge amount (μc/g) | Stability | Store stability | Vinyl chloride migration resistance | Circumstantial stability |
|---|---|---|---|---|---|
| Toner 12 | +12.0 | Good | good | no contamination | good |
| Toner 13 | +11.9 | " | " | no contamination | " |
| Toner 14 | +13.0 | " | " | no contamination | " |
| Toner 15 | +13.0 | " | " | no contamination | " |
| Toner 16 | +11.8 | " | " | no contamination | " |
| Toner 17* | +11.5 | " | " | no contamination | " |
| Toner 18 | −13.2 | " | " | no contamination | " |
| Toner 19 | −12.5 | " | " | no contamination | " |
| Toner 20 | −12.2 | " | " | no contamination | " |
| Toner 21 | −13.0 | " | " | no contamination | " |
| Comparative toner 9** | +2.8 | — | favorable | — | — |
| Comparative toner 10 | +13.5 | good | " | remarkable contamination | favorable |

TABLE 3-continued

| Toner | Friction charge amount (μc/g) | Stability | Store stability | Vinyl chloride migration resistance | Circumstantial stability |
|---|---|---|---|---|---|
| Comparative toner 11 | −18.0 | " | " | no contamination | favorable |
| Comparative toner 12 | −12.2 | " | " | remarkable contamination | " |
| Comparative toner 13 | −13.0 | not fixed portion present | " | remarkable contamination | failed |
| Comparative toner 14 | −13.0 | good | " | no contamination | " |

(note)
*For toner 17 positively charged property was provided with no charge controller by changing the coat resin for the carrier.
**For the comparative toner 9 no clear images were obtained since the charged amount of the toner was too low.

EXAMPLE 22

The resin E synthesized in Preparation Example 5 was used as the coating resin and coated on iron powder to obtain resin-coated carriers 1261 g of the carriers thus obtained, 39 g of the toners prepared in Example 3 and 7 g of fluidizing agent were mixed to prepare toners. When they were evaluated in a copying machine using an organic photosensitive material, sufficient image density was obtained and background contamination and other troubles did not occur at all.

EXAMPLE 23

The resin E synthesized in Preparation Example 5 was used as the coating resin and coated on iron powder to obtain resin-coated carriers.

1261 g of the carriers thus obtained, 39 g of the toners prepared in Example 8 and 7 g of fluidizing agent were mixed to prepare toners. When they were evaluated in a copying machine using an Se type photosensitive material, sufficient image density was obtained and background fogging and other troubles did not occur at all.

What is claimed is:

1. An electrophotographic developing toner composition which comprises a colorant and a polyester, said polyester having an acid value of 5 KOH mg/g or less and a hydroxyl value of 50 KOH mg/g or less, a softening point of 80° to 140° C. and a flow starting point with a difference of 10° to 40° C. between said softening point and said flow starting point; said polyester being linear and noncrosslinked.

2. A composition as claimed in claim 1, which further comprises an electric charge-controlling agent.

3. A composition as claimed in claim 2, in which said agent is for positive charging.

4. The composition as claimed in claim 1, in which said polyester has and a diol component which is an alkylene oxide adduct of bis-phenol A.

5. A composition as claimed in claim 3, in which said agent is a vinyl polymer having a monomer unit of an amine.

6. A composition as claimed in claim 2, in which said agent is for negative charging.

7. The composition as claimed in claim 6, wherein the negative charge controller is selected from the group consisting of a metal complex salt of monoazo dye, nitrohumic acid and salt thereof, materials having a nitro group, materials having a halogen element, sulfonated copper phthalocyanine, and maleic acid anhydride copolymer.

8. The composition as claimed in claim 1, wherein the polyester comprises an alcohol monomer selected from the group consisting of ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, bisphenol A, hydrogenated bisphenol A, polyoxyethylene bisphenol A, polyoxypropylene bisphenol A, dihydric alcohol, sorbitol, 1,2,3,6-hexanetetrol, 1,4-sorbitane, pentaerythrytol, dipentaerythrytol, tripenterythrytol, 1,2,4-butanetriol, 1,2,5-pentanetriol, glycelol, diglycelol, 2-methylpropane-triol, 2-methyl-1,2,4-butanetriol, trimethylolethane, trimethylolpropane and 1,3,5-trihydroxybenzene.

9. The composition as claimed in claim 1, wherein the polyester comprises an acid monomer selected from the group consisting of maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkenyl succinic acids, alkyl esters of alkenyl succinic acid, dibasic carboxylic acid, 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, tetra(methylenecarboxyl)methane, 1,2,7,8-octane tetracarboxylic acid, trimer acid anhydride, and alkyl esters thereof, alkenylesters thereof and aryl esters thereof.

10. The composition as claimed in claim 1, wherein the polyester comprises at least one member selected from the group consisting of 1,2,4-benzene tricarboxylic acid, trimethyl 1,2,4-benzene tricarboxylate, triethyl 1,2,4-benzene tricarboxylate and tri-n-butyl 1,2,4-benzene tricarboxylate, tri-iso-butyl 1,2,4-benzene tricarboxylate, tri-n-octyl 1,2,4-benzene tricarboxylate, tri-2-ethylhexyl 1,2,4-benzene tricarboxylate, tribenzyl 1,2,4-benzene tricarboxylate and tris(4-isopropylbenzyl) 1,2,4-benzene tricarobxylate.

11. The composition as claimed in claim 1, wherein the colorant is selected from the group consisting of carbon black, copper phthalocyanine, monoazo type pigment, disazo type pigment anthraquinone type pigment, and rohdamine type dye.

12. An electrostatic developing carrier which comprises core particles and a coating on said core particles, said coating comprising the composition of claim 1.

13. In a heat roller fixing electrophotographic process for developing a latent image using a toner composition comprising the steps of developing, transferring the heat roller fixing, the improvement comprising using as said toner composition the composition of claim 1.

14. An electrophotographic developing toner composition which comprises a colorant and a polyester, said polyester having an acid value of 5 KOH mg/g or less and a hydroxyl value of 50 KOH mg/g or less, a softening point of 90° to 150° C. and a flow starting point with a difference of 15° to 50° C. between said softening point and said flow starting point.

15. The composition as claimed in claim 14, in which said polyester has been produced by using a monomer having three or more reactive groups.

16. The composition as claimed in claim 15, which further comprises an electric charge-controlling agent for positive charging.

17. The composition as claimed in claim 16, wherein the positive charge controller is present in an amount of from 0.1 to 8.0 parts by weight based on 100 parts by weight of a thermoplastic resin.

18. The composition as claimed in claim 14, in which said polyester has a and a diol monomer for the polyester which is an alkylene oxide adduct of bisphenol A.

19. A composition as claimed in claim 18, in which said polyester has a polybasic acid component of the polyester has the formula (I):

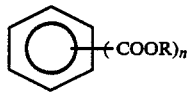

(I)

in which n is 3 or 4 and R is an alkyl group, an alkenyl group or an aryl group, having 1 to 18 carbon atoms.

20. A composition as claimed in claim 19, in which the polyester contains 2 to 50 mole percent, based on the entire acid component, of the polybasic acid component having the formula (I).

21. A composition as claimed in claim 19, in which the polybasic acid monomer having the formula (I) is selected from a triester of an alcohol having 8 carbon atoms and 1,2,4-benzene tricarboxylic acid, trimethyl 1,2,4-benzenetricarboxylate and triethyl 1,2,4-benzenetricarboxylate.

22. The composition of claim 14, which further comprises an electric charge-controlling agent.

23. An electrostatic developing carrier which comprises core particles and a coating on said core particles, said coating comprising the composition of claim 14.

24. In a heat roller fixing electrophotographic process for developing a latent image using a toner composition comprising the steps of developing, transferring the heat roller fixing, the improvement comprising using as said toner composition the composition of claim 14.

* * * * *